US011568765B2

(12) United States Patent
Robadey

(10) Patent No.: US 11,568,765 B2
(45) Date of Patent: Jan. 31, 2023

(54) SEALING DEVICE

(71) Applicant: ASSA ABLOY AB, Stockholm (SE)

(72) Inventor: Jean-Miguel Robadey, Bossonnens (CH)

(73) Assignee: ASSA ABLOY AB, Stockholm (SE)

( * ) Notice: Subject to any disclaimer, the term of this patent is extended or adjusted under 35 U.S.C. 154(b) by 292 days.

(21) Appl. No.: 16/762,193

(22) PCT Filed: Nov. 9, 2018

(86) PCT No.: PCT/EP2018/080761
§ 371 (c)(1),
(2) Date: May 7, 2020

(87) PCT Pub. No.: WO2019/096688
PCT Pub. Date: May 23, 2019

(65) Prior Publication Data

US 2020/0357308 A1 Nov. 12, 2020

(30) Foreign Application Priority Data

Nov. 16, 2017 (EP) ..... 17202124

(51) Int. Cl.
*G09F 3/03* (2006.01)

(52) U.S. Cl.
CPC ..... *G09F 3/0358* (2013.01); *G09F 3/0335* (2013.01)

(58) Field of Classification Search
CPC .... G09F 3/0358; G09F 3/0335; G09F 3/0317; G09F 3/0352; G09F 3/0364
USPC ..... 292/319, 307, 315, 358, 335, 317, 364, 292/352
See application file for complete search history.

(56) References Cited

U.S. PATENT DOCUMENTS 5,097,253 A 3/1992 Eschbach et al.
5,222,776 A 6/1993 Georgopoulos et al.
(Continued)

FOREIGN PATENT DOCUMENTS

CA 2740861 A1 * 5/2010 ..... G09F 3/0329
CN 100590289 C * 2/2010 ..... G09F 3/0358
(Continued)

OTHER PUBLICATIONS

"European Application Serial No. 17202124.8, Extended European Search Report dated May 29, 2018", 7 pgs.
(Continued)

*Primary Examiner* — Edwyn Labaze
(74) *Attorney, Agent, or Firm* — Schwegman Lundberg & Woessner, P.A.

(57) ABSTRACT

The present disclosure relates to a sealing device (10) for a container. The sealing device comprises a housing (12) housing an integrated circuit (14). A locking member (16) is slidably attached to the housing (12) and includes an electrical conductor (19) embedded therein. The electrical conductor (19) and the integrated circuit (14) form an RFID circuit when the locking member (16) is in a locking position. The electrical connection between the electrical conductor (19) and the integrated circuit (14) is broken when the locking member (16) is cut or forcibly removed from the housing (12) and cannot be re-established. In this manner, a manipulation of the sealing device (10) can be reliably prevented.

18 Claims, 4 Drawing Sheets

(56) References Cited

U.S. PATENT DOCUMENTS

| | | | | |
|---|---|---|---|---|
| 2002/0000110 | A1* | 1/2002 | Fantl | E05B 67/00 70/38 R |
| 2002/0171550 | A1 | 11/2002 | Hirose et al. | |
| 2003/0136162 | A1* | 7/2003 | Sutton | E05B 47/0623 70/276 |
| 2007/0139196 | A1 | 6/2007 | Rietzler | |
| 2018/0025673 | A1* | 1/2018 | Ritamäki | G09F 3/0352 340/572.8 |
| 2018/0171665 | A1* | 6/2018 | Anderson | G09F 3/0347 |

FOREIGN PATENT DOCUMENTS

| | | | | |
|---|---|---|---|---|
| EP | 3486889 | A1 | 5/2019 | |
| WO | WO-2006066555 | A1 * | 6/2006 | G06K 19/07798 |
| WO | WO-2019010480 | A1 * | 1/2019 | E05B 39/00 |
| WO | WO-2019096688 | A1 | 5/2019 | |

OTHER PUBLICATIONS

"International Application Serial No. PCT/EP2018/080761, International Search Report dated Jan. 24, 2019", 5 pgs.
"International Application Serial No. PCT/EP2018/080761, Written Opinion dated Jan. 24, 2019", 6 pgs.
"European Application Serial No. 17202124.8, Communication Pursuant to Article 94(3) EPC dated Jan. 11, 2021", 6 pgs.
"European Application Serial No. 17202124.8, Response filed May 10, 2021 to Communication Pursuant to Article 94(3) EPC dated Jan. 11, 2021", 13 pgs.
"European Application Serial No. 17202124.8, Communication Pursuant to Article 94(3) EPC dated Mar. 17, 2022", 6 pgs.

* cited by examiner

SEALING DEVICE

CROSS-REFERENCE TO RELATED APPLICATIONS

The present application is a national stage application under 35 U.S.C. § 371 of PCT Application No. PCT/EP2018/080761, filed Nov. 9, 2018, which claims the benefit of European Patent Application No. 17202124.8, filed Nov. 16, 2017, each of which is hereby incorporated herein by reference in its entirety.

TECHNICAL FIELD

The present disclosure generally relates to a sealing device, in particular, to an electronic seal for maritime or other containers that allows for securely and reliably detecting a tampering with the seal.

BACKGROUND

Generally, seals are used as part of a security system to determine whether, for example, a freight container has been tampered with, i.e., whether there has been unauthorized entry into the container through its doors. Seals can be effective only if users properly select, store, account for, apply, document and attend to the seals prior to use and in use.

There are many different types of sealing devices that are used in applications such as, for example, a security seal for postal bags, security boxes, doors, containers, etc. The sealing devices are usually identified using various methods using, for example, a bar code, an engraved serial number, or RFID tags. However, the means of identification usually provide no direct evidence of tampering with the sealing device other than by visually recognizing that tampering has occurred.

WO 2006/046157 A1 discloses a security sealing device comprising a sealing element, an integrated circuit and an antenna connected to the integrated circuit. The integrated circuit and the antenna form an RFID circuit. The sealing element is conductive and forms part of the antenna. Therefore, when an attempt is made to separate the sealing element from a housing of the sealing device, the RFID circuit is broken, and it is no longer possible to send a response when reading by an external device such as an RFID reader is performed. However, there may be cases where, for example, the sealing element can be re-connected after being separated from a corresponding connector without leaving an obvious visible or electronic proof that tampering has occurred.

US 2011/0279236 A1 discloses another sealing device including a housing and a closure member having a first and a second end. At least one of the first and second ends is removably attached to the housing. The housing has means for checking the integrity of the closure member and a first transponder for transmitting information on the status of the sealing device. The sealing device further includes a second transponder associated with at least one of the first and second ends of the closure member and comprising a second identity. The sealing device further includes a transponder reader associated with the first transponder and arranged for reading the second identity of the second transponder. The first transponder is configured to receive the second identity from the transponder reader and transmit the second identity.

US 2007/0139196 A1 discloses a seal device with a seal body and an attachment device for the captive attachment of the seal body to an object to be sealed. One end of the attachment device is connected in a single piece with the seal body.

U.S. Pat. No. 5,097,253 relates to a security device having a control box containing an electronic system and a communications loop over which the system transmits a signal.

US 2002/0171550 A1 discloses a tag device wherein a wire has a base end fixed to a tag body and a forward end connected to the tag body. The wire is provided at its forward end with a lock pin.

The present disclosure is directed, at least in part, to improving or overcoming one or more aspects of prior systems.

SUMMARY OF THE DISCLOSURE

According to one aspect of the present disclosure, a sealing device comprises a housing, an integrated circuit accommodated in the housing, and a locking member slidably attached to the housing. The locking member has a first end accommodated in the housing, an electrical conductor embedded in the locking member and electrically connected to the integrated circuit, and a second end configured to be inserted into the housing when the locking member is slid along a locking direction from an unlocking position, in which the second end is disposed outside the housing, to a locking position, in which the second end is disposed in the housing. The sealing device further comprises a locking mechanism configured to securely engage the locking member in the locking position, and a contact device provided in the housing and electrically connected to the integrated circuit. An electrical connection between the electric conductor and the contact device is established after engagement of the second end by the locking mechanism.

Other features and aspects of the present disclosure will be apparent from the following description and the accompanying drawings.

DETAILED DESCRIPTION

Figure 1:
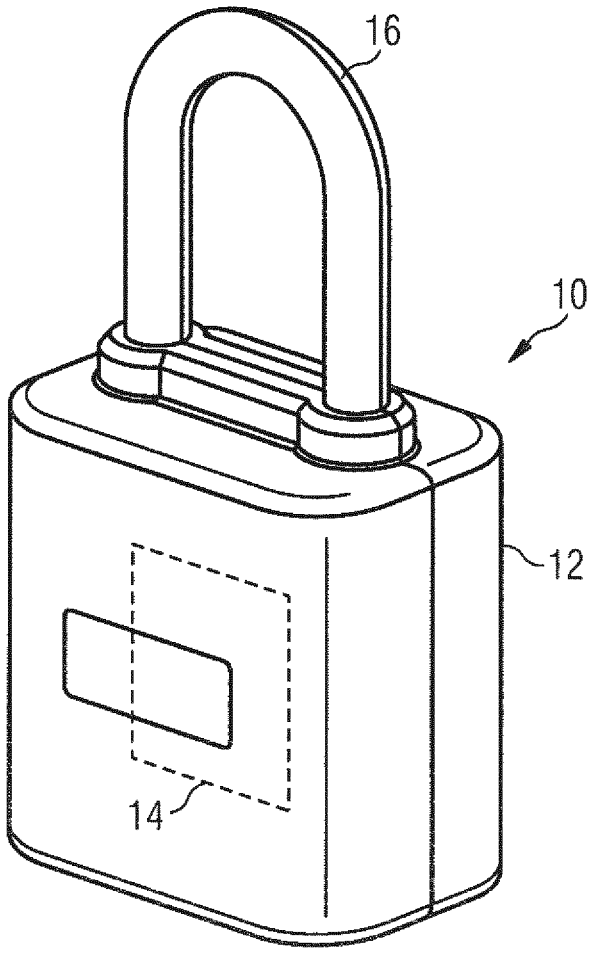
FIG. 1 is a schematic perspective view of a sealing device in accordance with the present disclosure in a locked state.

The following is a detailed description of exemplary embodiments of the present disclosure. The exemplary embodiments described herein are intended to teach the principles of the present disclosure, enabling those of ordinary skill in the art to implement and use the present disclosure in many different environments and for many different applications. Therefore, the exemplary embodiments are not intended to be, and should not be considered as, a limiting description of the scope of protection. Rather, the scope of protection shall be defined by the appended claims.

The present disclosure is based at least in part on the realization that, in some cases, a purely mechanical seal may not be sufficient for the protection of goods, for example, goods that are transported in maritime containers. Therefore, smart seals with more intelligence may be required, which become at least partially non-functional when tampering has occurred. However, such electronic seals cannot always reliably inform an interrogator that tampering has occurred. Thus, a solution is required that can reliably inform the interrogator in case of tampering with a sealing device, or in case the sealing device is not locked properly.

In this respect, it has been realized that a smart seal that has an appearance and function that is similar to known mechanical seals, for example, a padlock, can be advantageously combined with an RFID circuit arranged in a housing of the seal. The proposed sealing device has a comparatively high mechanical strength due to a preferably rigid locking member and can therefore be easily applied in order to lock, for example, a container in a manner that is familiar to the user. Further, the locking mechanism of the sealing device is configured such that it securely engages an end of the locking member in the locking position, such that it is not possible to remove the locking member after locking has been performed. In addition, an RFID loop is only completed when the locking member has been securely engaged by the locking mechanism.

The present disclosure may further be based on the realization that it is advantageous when the part of the RFID loop that is arranged in the locking member is not visible. In other words, it is not immediately obvious to a potential perpetrator that the sealing device is a smart device that includes the RFID circuit. Therefore, when the perpetrator, for example, cuts the locking member, the RFID loop is broken and cannot be re-connected. In this respect, it is advantageous to arrange the conductor inside the locking member in such a manner that, when the locking member is broken, the conductor does not protrude from the locking member, such that it is impossible or at least very difficult to re-connect the conductor by re-connecting the free ends of the same.

The present disclosure is also based at least in part on the realization that, by providing a weak point on the locking member at a position that is within the housing of the sealing device in the locking position, when an attempt is made to forcibly remove the locking member from the housing, the locking member will break at the weak point in such a manner that the conductor inside the locking member is also broken. In other words, parts of the locking member and the conductor remain in the housing and cannot be removed. As a consequence, it is nearly impossible to re-connect the conductor at the breaking point of the same.

In addition, the present disclosure is also based on the realization that it is advantageous to assure that the electrical contact between the conductor in the locking member and a corresponding contact in the housing is only established when the locking member is securely locked. In this manner, it is not possible to manipulate the system by only partially inserting the locking member into the housing in order to close the contact.

Figure 2:
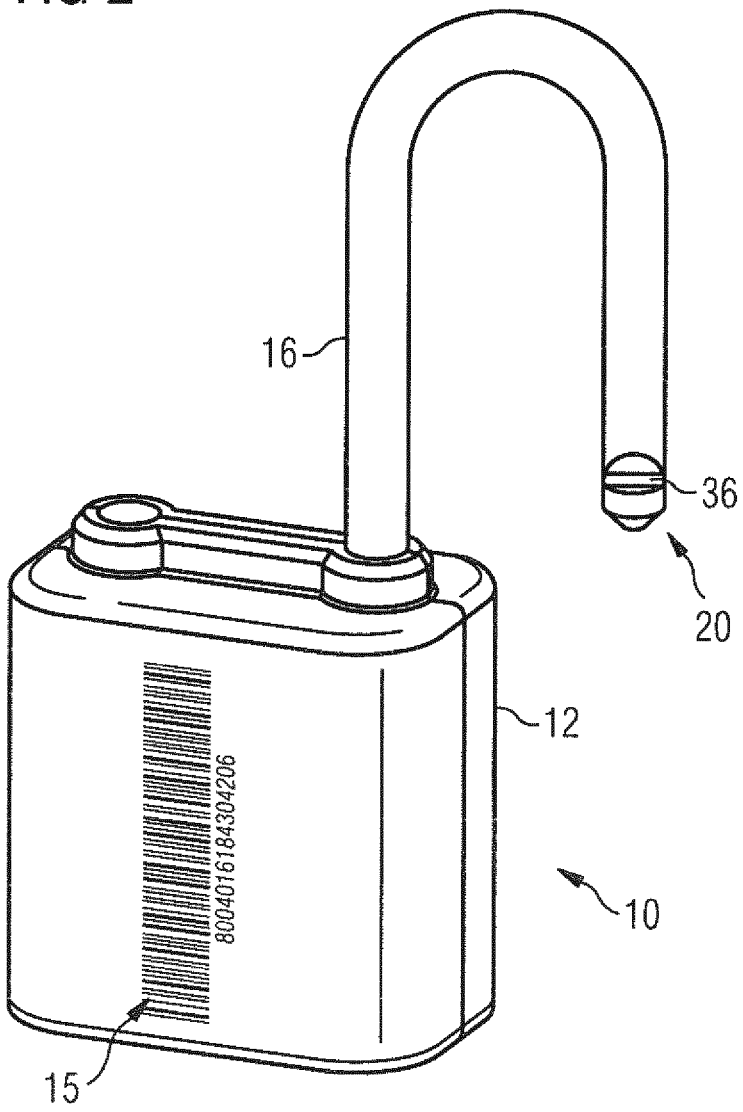
FIG. 2 is a schematic perspective view of the sealing device of FIG. 1 in an unlocked state.

Referring now to FIGS. 1 and 2, an exemplary sealing device 10 in accordance with the present disclosure is shown. FIG. 1 shows sealing device 10 in a locked state, while FIG. 2 shows sealing device 10 in an unlocked state. As shown in FIGS. 1 and 2, sealing device 10 includes a housing 12, an integrated circuit 14 housed inside housing 12, and a locking member 16.

Housing 12 has a substantially rectangular shape, similar to the shape of a mechanical lock such as a padlock. Housing 12 may be made of any suitable material that has the required mechanical strength to protect integrated circuit 14 and prevent easy access to the interior of housing 12. For example, housing 12 can be formed of metal or plastics having a sufficient durability/strength, such as ABS with high impact resistance and toughness. In the top surface of housing 12, two substantially circular openings are formed. In one of said openings, locking member 16 is slidably inserted and attached to housing 12 such that it cannot be removed from the same. The other opening is configured to receive the free end of locking member 16 when sealing device 10 is locked, as described below in more detail.

Locking member 16 is configured as a rigid locking member with, for example, a U-shape. As shown in FIGS. 1 and 2, locking member 16 is attached to housing 12 in such a manner that it can be slid (moved) in a locking direction (see FIG. 3) with respect to housing 12. In this manner, sealing device 10 can be locked by rotating locking member 16 to align its free end with the opening in housing 12 and moving the same along the locking direction (a longitudinal direction of housing 12) in a known manner. As shown in FIG. 2, a weak point 36, which will be described in more detail below, may be formed as a groove at the free end of locking member 16 to extend substantially perpendicular to the locking direction. In some embodiments, weak point 36 may also be provided at a different position, for example, as a circumferential groove provided in a portion of locking member 16, for example, just above the above-mentioned groove at the free end of locking member 16. As also shown in FIG. 2, an identifier 15 is provided on an outer surface of housing 10 in order to facilitate identification of sealing device 10 in a unique manner.

Integrated circuit 14 may be a known electronic circuit, in particular, an RFID circuit. Integrated circuit 14 may include components such as a processor, a memory such as a ROM, etc. that are required to execute commands using, for example, known RFID protocols. In particular, integrated circuit 14 may function in a known manner as a passive RFID device when an interrogation signal is received from a corresponding RFID reader. As will be described in more detail below, an RFID loop or antenna is formed in part by an electrical conductor 19 that is embedded in locking member 16 (see FIG. 3). In some embodiments, integrated circuit 14 may be configured to transmit a unique ID associated with sealing device 10 when the interrogation signal is received. The unique ID may be associated with identifier 15 on housing 12, for example, in a central database or the like. In this manner, even in case of tampering, for example, replacing integrated circuit 14 after breaking sealing device 10, it can be determined that tampering has occurred, because the unique ID no longer matches identifier 15.

Figure 3:
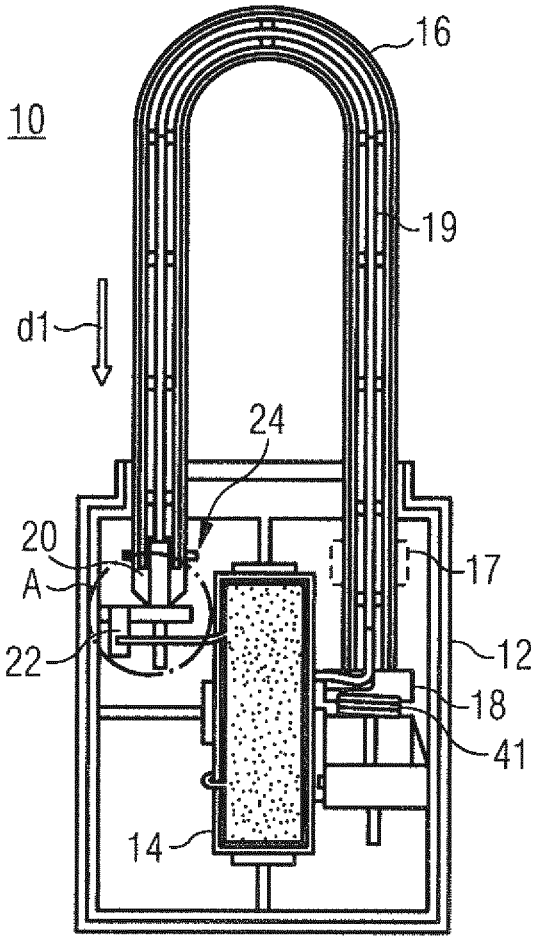
FIG. 3 is a schematic cross-sectional view of the sealing device of FIG. 1.

FIG. 3 shows the internal configuration of sealing device 10 in more detail. In particular, FIG. 3 shows electrical conductor 19 embedded in locking member 16 to extend substantially parallel to the same. For example, electrical conductor 19 may include a wire 21 (see also FIG. 5) that is connected to integrated circuit 14 at a first end 18 of locking member 16, for example, by a wire extension 32 with a length that is at least the same as a distance between first end 18 and a terminal 34 of integrated circuit 14 to which wire 21 is connected when locking member 16 is in an unlocking position, i.e. protrudes from housing 12. In some embodiments, conductor 19 may be embedded inside locking member 16 in such a manner that it cannot be moved relative to the same, for example, by molding, co-extrusion, gluing, soldering or the like. To prevent locking member 16 from being removed from housing 12, a base portion with a diameter that is greater than a diameter of the opening through which locking member 16 is inserted is formed at first end 18. First end 18 is biased towards this opening by an elastic element 41, for example, a coil spring or the like.

As shown in FIG. 3, locking member 16 is configured to be slid along locking direction d1 from an unlocking position, in which a second, free end 20 is disposed outside housing 12, to a locking position, in which second end 20 is disposed inside housing 12. As a result, elastic element 41 is compressed. At the same time, it can be assured by wire extension 32 that electrical conductor 19 remains connected to integrated circuit 14 regardless of whether locking member 16 is in the unlocking position or in the locking position.

Figure 4:
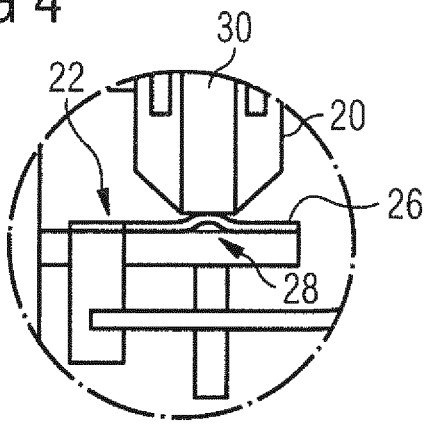
FIG. 4 is an enlarged view of a region A in FIG. 3 showing a contact device in accordance with the present disclosure.

As shown in FIG. 4, at first end 20, locking member 16 has an electrically conducting contact pin 30 as part of electrical conductor 19 embedded in locking member 16. Contact pin 30 is electrically connected to wire 21 and at least partially exposed from locking member 16 at second end 20. In particular, a front surface of contact pin 30 may be substantially aligned with a front surface of locking member 16, or may protrude from the same by a predetermined amount. In such a manner, contact pin 30 can come into contact with a contact device 22 provided in housing 12 and electrically connected to integrated circuit 14, as shown in FIG. 3.

In some embodiments, an anti-rotation mechanism 17 may be provided either in housing 12 or on an outer surface of the same to prevent or limit a rotation of locking member 16, in particular, in the unlocking position, around an axis of rotation that is parallel to locking direction d1. In this case, in some embodiments, an appropriate alignment of second end 20 with the opening in housing 12 can be maintained at all times, such that sealing device 10 can be conveniently locked only by sliding locking member 16 in locking direction d1. In other embodiments, anti-rotation mechanism 17 may be configured to limit an angular position of locking member 16 to a predetermined range, and only allow movement of locking member 16 in locking direction d1 when second end 20 is aligned with the opening in housing 12. For example, a rib or other protrusion may be formed on locking member 16 and be configured to abut against corresponding abutment portions to limit the rotation of locking member 16 inside housing 12. Further, the rib may be configured to be disposed outside a longitudinal groove formed in a guide portion for locking member 16 when in the unlocking position, and may only be inserted into the longitudinal groove when second end 20 is aligned with the opening in housing 12. As only schematically shown in FIG. 3, sealing device 10 further includes a locking mechanism 24 configured to securely engage second end 20 of locking member 16 in the locking position. This will be described in more detail below with reference to FIG. 5.

FIG. 4 shows contact device 22 in more detail. As shown in FIG. 4, contact device 22 includes a contact plate 26 electrically connected to integrated circuit 14. As shown in FIG. 4, contact plate 26 may be arranged in housing 12 to extend substantially perpendicular to locking direction d1, i.e. the direction of extension of locking member 16 at second end 20. Contact plate 26 is arranged and configured in such a manner that second end 20 of locking member 16, in particular, contact pin 30 embedded therein, contacts contact plate 26 when second end 20 is engaged by locking mechanism 24 in the locking position. Thereby, an electrical connection is formed between electrical conductor 19 and contact device 22 upon engagement of second end 20 by locking mechanism 24.

To assure that the electrical contact between electrical conductor 19 and contact device 22 can be reliably established when locking member 16 has been inserted into housing 12 and securely engaged by locking mechanism 24 in the locking position, contact plate 26 includes a flexible portion 28 configured to be pressed by second end 20 in locking direction d1 when second end 20 is brought into engagement with locking mechanism 24. Accordingly, due to flexible portion 28 being pressed by second end 20 and deformed, a restore force acts in the direction opposite to locking direction d1 and presses flexible portion 28 against contact pin 30. Therefore, the electrical connection in the locking position can be reliably established and maintained. It will be appreciated that, in other embodiments, contact device 22 may have a different configuration, for example, as a leaf spring, or include a contact that is biased towards second end 20 by a separate biasing member or the like.

Figure 5:
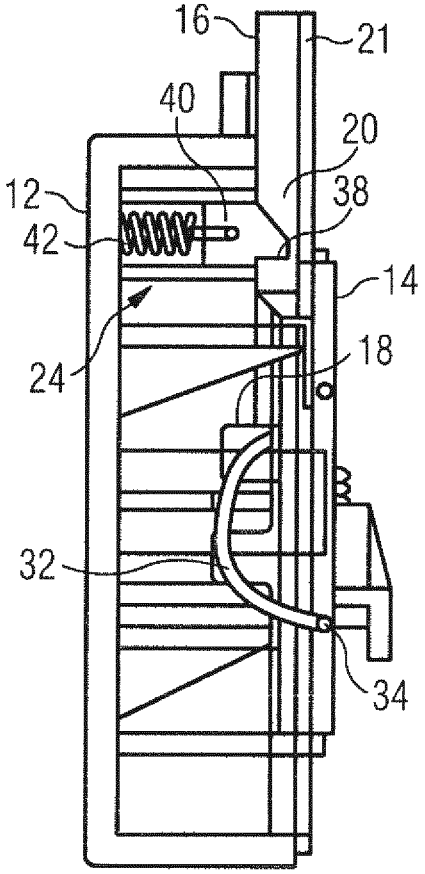
FIG. 5 is a partial sectional view of the sealing device of FIG. 1 showing a locking mechanism in accordance with the present disclosure.

FIG. 5 shows locking mechanism 24 in more detail. As shown in FIG. 5, locking mechanism 24 includes a movable member 40 that is biased towards locking member 16, for example, by a spring 42 in a direction perpendicular to locking direction d1. Movable member 40 is a substantially cylindrical member having a tapered shape at a front end of the same. The tapered shape is configured to fit into a groove 38 that is formed as weak point 36 at second end 20 of locking member 16. In particular, movable member 40 includes a nose that protrudes into groove 38 when locking member 16 is in the locking position. The nose is configured such that a substantially horizontal flat surface is formed at a lower end of movable member 40, and a tapered portion with a reduced dimension towards the upper side extends from the substantially flat surface. With this configuration, as can be easily recognized from FIG. 5, movable member 40 can be moved by locking member 16 against the biasing force of biasing element 42 into a retracted position when second end 20 is inserted into housing 12 to allow locking member 16 to pass. In the locking position, groove 38 is aligned with movable member 40, and movable member 40 moves into groove 38 due to the biasing force of biasing element 42. Accordingly, locking mechanism 24 securely engages second end 20. In particular, the lower surface of movable member 40 and the mating surface of groove 38 both extend substantially horizontally. Therefore, when a force acts against locking member 16 in a direction opposite to locking direction d1, movement of locking member 16 is blocked by movable member 40.

Once locking member 16 has been locked in the locking position, locking mechanism 24 cannot be unlocked. In this manner, the electrical connection between both ends of locking member 16 (electrical conductor 19) and integrated circuit 14 is reliably maintained in the locking position. As can be seen in FIG. 3, this results in a loop being formed by integrated circuit 14 and electrical conductor 19 via contact device 22. As a consequence, integrated circuit 14 and electrical conductor 19 form an RFID circuit. When an interrogation signal is received in this state, integrated circuit 14 is configured to output the unique ID stored in the same and/or an acknowledgement or the like, which is then received by the corresponding interrogation device. In this manner, it can be verified that the RFID circuit has not been broken, in other words, the mechanical connection between housing 12 and locking member 16 has not been broken and sealing device 10 has not been tampered with.

INDUSTRIAL APPLICABILITY

As described above, with the sealing device disclosed herein, goods that are transported, for example, by maritime containers can be securely protected, and any tampering with sealing device 10 can be reliably detected by an RFID reader. The security obtained using the claimed sealing device includes several aspects.

In a first aspect, as wire 21 is embedded in locking member 16 in such a manner that it is not visible from outside, a potential perpetrator cannot even recognize that a security mechanism including such an electrical conductor is present in sealing device 10, which has the appearance of an ordinary mechanical lock. Therefore, when the perpetrator manipulates sealing device 10, for example, by cutting locking member 16 or forcibly removing the same from housing 12, electrical conductor 19 will inevitably be broken, and integrated circuit 14 either can no longer transmit a signal in response to an interrogation signal, or transmits a signal that indicates that the sealing device has been tampered with (for example, by transmitting a bit that changes its value when the circuit is broken).

Here, advantageously, wire 21 is embedded in locking member 16 in such a manner that, when locking member 16 is broken or cut, no free ends of wire 21 protrude from the same. In other words, the length of wire 21 closely matches the total length of locking member 16. Therefore, it becomes almost impossible to re-connect wire 21 after it has been broken, in particular, when wire 21 is embedded such that it cannot move with respect to locking member 16.

In addition, weak point 36 provided in second end 20 results in that locking member 16 will break at weak point 36 when it is forcibly removed from housing 12 such that part of wire 21 and/or contact pin 30 remains in housing 12. Therefore, the RFID circuit is broken, and it is also not possible to close or re-connect the RFID circuit, because part of electrical conductor 19 remains inside housing 12 and is not accessible. This further increases the security of sealing device 10.

In addition, with the configuration of locking mechanism 24, an electrical contact between contact pin 30 and contact plate 26 is only established after locking mechanism 24 has securely engaged locking member 16. In this manner, the possibility of fraud or the like is also suppressed, because it is not possible to simulate locking of sealing device 10 by only partially inserting locking member 16 into housing 12. In this case, the RFID circuit will not be formed, and it could easily be verified using, for example, an interrogation device or the like that sealing device 10 has in fact not been locked. In addition, the construction of locking mechanism 24 disclosed herein provides good tactile feedback to a user of sealing device 10. Therefore, it is very easy for the user to identify when sealing device 10 has been successfully and completely locked. Therefore, it is not even necessary to confirm whether the RFID circuit has been formed using an interrogation device.

While sealing device 10 has been described as being used for containers, in particular, maritime containers, it will be readily appreciated that the sealing device disclosed herein can also be used for other applications, for example, rail cars or truck trailers, doors or windows of buildings, a secure box or a metering device, etc.

Although locking member 16 has been shown as substantially U-shaped, it will be readily appreciated that any appropriate shape can be used for locking member 16, as long as it comprises straight portions at both ends that allow for the sliding movement of the same with respect to housing 12 and the insertion of second end 20 into housing 12 when sealing device 10 is locked. Further, locking member 16 may be formed of any appropriate material that has a sufficient rigidity/strength to facilitate easy movement along locking direction d1 without deforming locking member 16 and/or electrical conductor 19 such that electrical conductor 19 is broken. Materials to be used for locking member 16 may, for example, be plastics such as ABS with high impact resistance and PA loaded with glass fiber, or metal.

While conductor 19 has been described as including wire 21 and contact pin 30, in other embodiments, contact pin 30 may be omitted. Further, it will be appreciated that wire extension 34 may be integrally formed with wire 21, or may be a separate wire connected to the same.

While sealing device 10 has been described as including integrated circuit 14 as part of a passive RFID circuit, it will be appreciated that, in other embodiments, integrated circuit 14 can be part of another circuit, for example, an active RFID circuit or the like. Further, in some embodiments, one or more additional circuits, for example, an active RFID circuit or the like, may be provided in sealing device 10, either as backup or as an additional security measure. In this case, it is contemplated that conductor 19 is also part of one or more additional circuits that are interrupted when tampering occurs, for example, by forcibly removing locking member 16 from housing 12. For example, a power supply of an additional active RFID circuit could be interrupted in this manner. Therefore, regardless of which interrogation method is used, it can be detected that tampering has occurred. In another alternative, a controller with a separate power supply could be configured to detect that the circuit including conductor 19 has been interrupted and, for example, generate an alarm by a corresponding transmission and/or setting of a bit value that is read out by an interrogation device, etc.

It will be appreciated that the foregoing description provides examples of the disclosed systems and methods. However, it is contemplated that other implementations of the disclosure may differ in detail from the foregoing examples. All references to the disclosure or examples thereof are intended to reference the particular example being discussed at that point and are not intended to imply any limitation as to the general disclosure.

Recitation of ranges of values herein are merely intended to serve as a shorthand method for referring individually to each separate value falling within the range, unless otherwise indicated herein, and each separate value is incorporated into the specification as if it were individually recited herein. All method steps described herein can be performed in any suitable order, unless otherwise indicated or clearly contradicted by the context.

Although the preferred embodiments of the present disclosure have been described herein, improvements and modifications may be incorporated without departing from the scope of the following claims.

The invention claimed is:

1. A sealing device comprising:

a housing accommodating an integrated circuit;

a locking member slidably attached to the housing, the locking member having a first end slidably accommodated in the housing in a manner that it cannot be removed from the same, an electrical conductor embedded in the locking member and electrically connected to the integrated circuit, and a second end configured to be inserted into the housing when the locking member is slid along a locking direction from an unlocking position, in which the second end is disposed outside the housing, to a locking position, in which the second end is disposed in the housing;

a locking mechanism configured to securely engage the locking member in the locking position; and a contact device provided in the housing and electrically connected to the integrated circuit;

wherein an electrical conductor includes:

a wire extending inside the locking member substantially between the first end and the second end; and an electrically conducting contact pin embedded in the locking member at the second end, the contact pin being electrically connected to the wire and at least partially exposed from the locking member to come into contact with the contact device when the second end is engaged by the locking mechanism; and wherein an electrical connection between the electrical conductor and the contact device is established after engagement of the second end by the locking mechanism.

2. The sealing device of claim 1, wherein the contact device includes a contact plate electrically connected to the integrated circuit, the contact plate being configured to contact the second end of the locking member when the second end is engaged by the locking mechanism.

3. The sealing device of claim 2, wherein the contact plate includes a flexible portion configured to be pressed by the second end in the locking direction when the second end is brought into engagement with the locking mechanism.

4. The sealing device of claim 1, wherein the wire extends substantially parallel to the locking member inside the same, with a length that substantially matches the length of the locking member.

5. The sealing device of claim 1, wherein the wire is connected to the integrated circuit at the first end by a wire extension having a length that is at least the same as a distance between the first end and a terminals of the integrated circuit to which the wire is connected when the locking member is in the unlocking position.

6. The sealing device of claim 1, further comprising an anti-rotation mechanism configured to prevent or limit a rotation of the locking member in the unlocking position around an axis of rotation that is parallel to the locking direction.

7. The sealing device of claim 1, wherein the locking member includes a weak point formed at the second end, the weak point being configured to break when a force exerted on the locking member in the locking position in a direction opposite to the locking direction exceeds a predetermined threshold.

8. The sealing device of claim 7, wherein the electrical conductor is arranged in the locking member such that breaking of the locking member at the weak point results in breaking of the electrical conductor inside the locking member.

9. The sealing device of claim 8, wherein the weak point is configured as a groove formed in the locking member, and the locking mechanism is configured to engage the groove in the locking position.

10. The sealing device of claim 9, wherein the locking mechanism includes a movable member biased towards the locking member and having a tapered shape configured to be moved by the second end against the biasing force when the second end contacts the same, and to move into the groove when the locking member reaches the locking position.

11. The sealing device of claim 1, wherein the locking mechanism is configured such that, once the locking member has been locked in the locking position, the locking mechanism cannot be unlocked.

12. The sealing device of claim 1, wherein the integrated circuit and the electrical conductor form at least part of an RFID circuit.

13. The sealing device of claim 12, wherein the integrated circuit includes a unique ID associated with the sealing device.

14. The sealing device of claim 13, further comprising a unique identifier provided on the housing, the identifier being associated with the unique ID of the integrated circuit.

15. The sealing device of claim 1, wherein the locking member is a rigid locking member.

16. The sealing device of claim 15, wherein the locking member is a substantially U-shaped rigid locking member.

17. The sealing device of claim 1, wherein the locking mechanism cannot be unlocked after engagement of the second end by the locking mechanism.

18. A sealing device comprising:

a housing accommodating an integrated circuit:

a locking member slidably attached to the housing, the locking member having a first end slidably accommodated in the housing in a manner that it cannot be removed from the same, an electrical conductor embedded in the locking member and electrically connected to the integrated circuit, and a second end configured to be inserted into the housing when the locking member is slid along a locking direction from an unlocking position, in which the second end is disposed outside the housing, to a locking position, in which the second end is disposed in the housing;

a locking mechanism configured to securely engage the locking member in the locking position; and a contact device provided in the housing and electrically connected to the integrated circuit;

wherein an electrical connection between the electrical conductor and the contact device is established after engagement of the second end by the locking mechanism; and wherein the integrated circuit and the electrical conductor form at least part of an RFID circuit.

* * * * *